US010619979B2

(12) United States Patent
Francez

(10) Patent No.: US 10,619,979 B2
(45) Date of Patent: Apr. 14, 2020

(54) FLYING TARGET THROWING EQUIPMENT

(71) Applicant: Stephen Edward Francez, Lafayette, LA (US)

(72) Inventor: Stephen Edward Francez, Lafayette, LA (US)

( * ) Notice: Subject to any disclaimer, the term of this patent is extended or adjusted under 35 U.S.C. 154(b) by 0 days.

(21) Appl. No.: 16/441,890

(22) Filed: Jun. 14, 2019

(65) Prior Publication Data

US 2019/0383587 A1 Dec. 19, 2019

Related U.S. Application Data

(60) Provisional application No. 62/807,450, filed on Feb. 19, 2019, provisional application No. 62/685,109, filed on Jun. 14, 2018.

(51) Int. Cl.
*F41J 9/18* (2006.01)
*F41J 9/30* (2006.01)

(52) U.S. Cl.
CPC .. *F41J 9/18* (2013.01); *F41J 9/30* (2013.01)

(58) Field of Classification Search
CPC ..... F41J 9/18; F41J 9/30
USPC ..... 124/6, 7, 8, 32, 42, 43, 46, 82
See application file for complete search history.

(56) References Cited

U.S. PATENT DOCUMENTS 1,332,735 A * 3/1920 McMillan ..... F41J 9/30 124/1
3,093,127 A * 6/1963 Starr ..... F41J 9/30 124/8
3,130,717 A * 4/1964 Moinil ..... F41J 9/18 124/1
3,322,108 A * 5/1967 Hoag ..... F41J 9/30 124/8
4,077,384 A * 3/1978 Montefeltro R. ..... F41J 9/16 124/1
4,205,651 A * 6/1980 Lante-Montefeltro Della Rovere ..... F41J 9/18 116/137 R
4,508,093 A * 4/1985 Bertini ..... F41J 9/18 124/1
5,406,928 A * 4/1995 Panara ..... F41J 9/30 124/47

(Continued)

OTHER PUBLICATIONS

International Search Report and Written Opinion dated Aug. 29, 2019, from Applicant's counterpart International Patent Application No. PCT/US2019/37331.

*Primary Examiner* — Alexander R Niconovich
(74) *Attorney, Agent, or Firm* — Jones Walker LLP

(57) ABSTRACT

A device for launching a target having an arm motor a gear motor shaft coupled to the arm motor configured to rotate right and left rotating arms, and right and left target loading arms each having (1) a cam assembly coupled to a corresponding rotating arm and (2) and arm extension. The device includes a horizontal linear loader configured to hold a plurality of targets and a backstop, where one of the plurality of targets sits against the backstop, where the right and left loading arms via the corresponding arm extensions lift a target up from the backstop. The device includes an oscillation motor coupled to a throwing motor, the throwing motor being connected to a beak assembly configured to hold the lifted target, the oscillation motor turns the throwing motor, and the turning of the throwing motor spins the lifted target held on the beak assembly.

23 Claims, 7 Drawing Sheets

(56) References Cited

U.S. PATENT DOCUMENTS

| | | | | |
|---|---|---|---|---|
| 5,771,874 | A * | 6/1998 | Kohler | F41J 9/30 124/8 |
| 5,871,003 | A * | 2/1999 | Laporte | F41J 9/18 124/8 |
| 6,431,161 | B1 * | 8/2002 | Gustafsson | F41J 9/30 124/8 |
| 6,588,410 | B1 * | 7/2003 | Graber | F41J 9/24 124/8 |
| 6,758,203 | B1 * | 7/2004 | Wu | F41J 9/18 124/6 |
| 9,389,050 | B1 * | 7/2016 | Chen | F41J 9/20 |
| 10,488,162 | B2 * | 11/2019 | Laporte | F41J 9/30 |
| 2006/0065258 | A1 * | 3/2006 | Lovell | F41J 9/24 124/9 |
| 2011/0186023 | A1 * | 8/2011 | Callander | F41J 9/18 124/6 |
| 2011/0260404 | A1 * | 10/2011 | Laporte | F41J 1/01 273/362 |
| 2012/0138034 | A1 * | 6/2012 | Whidborne | F41J 9/18 124/8 |
| 2016/0223300 | A1 * | 8/2016 | Gonzalez Fernandez | F41J 9/18 |

* cited by examiner

FLYING TARGET THROWING EQUIPMENT

CROSS-REFERENCE TO RELATED APPLICATIONS

This application claims the benefit of and priority to U.S. Provisional Patent Application No. 62/685,109 filed on Jun. 14, 2018, and the benefit of and priority to U.S. Provisional Patent Application No. 62/807,450 filed on Feb. 19, 2019, which are both incorporated herein by reference in their entirety for any and all purposes.

BACKGROUND OF THE DISCLOSURE

In clay target shooting sports, "Trap" is a well-known event, where people shoot at a series of clay targets exiting from a box launcher. The shooter knows the height and direction of the targets, which are always launched from the box launcher in the same way. The shooter's interception of each target is the objective. The targets can have different shapes according to the type of trajectory they trace in the shooting area. The trajectory of the axially symmetrical clays targets is usually quite predictable by the most experienced shooters. Because of this, the axially symmetrical clays have been replaced by flying targets shaped to trace more unpredictable trajectories in order to make hitting the target more challenging. To this end, in the '60s, a target, commonly called "helice," was designed and constructed. It comprises a central body made of flexible plastic and a helical body, provided with two opposite blades and made of rigid plastic. These kinds of targets are used in the discipline called "electrocibles."

The central body of the target, usually named as "witness cap," is shaped similar to the convex surface of a clay target. As such, the witness cap is connected in a snap-like manner to the helical body (which it may be detachable from), which acts as a support for the same witness cap. In some cases, the helical (or firmed) body has mushroom shaped pins, which couple with housings provided in the peripheral part of the witness cap. The material of which the witness cap is made is flexible, meaning that, when hit by projectiles, it does not break, and if it falls into a designated area, a point is scored, such as in the discipline called electrocibles.

A device for launching of flying targets is the subject of this application.

SUMMARY OF THE DISCLOSURE

The disclosed embodiments of the present disclosure described herein provide a new, automated way of loading and launching flying targets made of various material, such as helice targets, clay targets, plastic targets, skeet, and the like. The embodiments save time loading targets and maintain the integrity of the targets. The disclosed embodiments reduce target jams and breakage, and allow for the use of any manufacture of helice target.

As such, the disclosed embodiments provide for a device for launching a target having an arm motor a gear motor shaft coupled to the arm motor configured to rotate right and left rotating arms, and right and left target loading arms each having (1) a cam assembly coupled to a corresponding rotating aim and (2) and arm extension. The device includes a horizontal linear loader configured to hold a plurality of targets and a backstop, where one of the plurality of targets sits against the backstop, where the right and left loading arms via the corresponding arm extensions lift a target up from the backstop. The device includes an oscillation motor coupled to a throwing motor, the throwing motor being connected to a beak assembly configured to hold the lifted target, the oscillation motor turns the throwing motor, and the turning of the throwing motor spins the lifted target held on the beak assembly.

In some embodiments, a single rotation of a gear motor shaft is all that is needed to load the target on the arm, load the target onto the throwing motor, and then back to pick up the next target. This is unique to this equipment and reduces the complexity of the automatic loading of helice to a single rotation, eliminating the need for complex computer electronics, mechanical complexity, and the labor that is required of both automated and non-automated equipment.

In some embodiments, unlike conventional automated equipment where the motor is brought to the target, the equipment of the present disclosure brings the target to the motor, and this, in and of itself, eliminates major mechanical, computer, and electronic issues associated with conventional automated loaders.

In some embodiments, the equipment of the present disclosure is used to launch two-piece targets for Helice competitions and the practice. The machine works by placing targets in the horizontal linear loader. The targets fit together and line up against a backstop, the target against the backstop being ready to load. When the arm motor is activated, the shaft turns a set of rotating arms that fits into cams on the target loading arms, forcing the arms up in tandem and the hooks on the arm extensions under the first target. The arms then move up, lifting the target along an axis that intersects the center line axis of the throwing motor at the apex of the arm; at this point the rotation of the arm motor pushes the stop in the cam and glides the arm and target back in a linear direction, allowing the target to seat on the beak assembly attached to the throwing motor, which holds and spins the target at up to 10,000 RPMs, until it is released by the shooter upon his call, either by voice activation or a manual switch that activates the linear actuator, which releases the target.

In some embodiments, once a target is set at the throwing motor and before it starts to spin, the arms start back to pick up the next target to reload after the currently-set target is thrown. The target starts to spin once the arms and arm extensions clear, activating the oscillating motor to start turning the throwing motor. The linear loader is activated when the arms return to their beginning point, and it sets the next target against the backstop, ready to be lifted after a target is released. The entire process is repeated.

In some embodiments, the helice equipment of the present disclosure automatically loads targets by bringing the target to the throwing motor, instead of the motor to the target, more closely mimicking manually-loaded equipment, where the target is placed at the motor by hand.

In some embodiments, the embodiments of the present disclosure may be used by individuals participating in the shooting sport of Helice. The linear loader would be filled with helice targets, and the shooter would activate the equipment by pressing a button—upon the shooter's calling "pull," a target would be released from a random one of five machines set in front of the shooter. The shooter would then attempt to shoot the target and score a hit. Some unique features of the disclosed embodiments may include:

1) The linear loader uses an all thread to move the target and set it into position; this device is simple and reduces vibration and stress on the target. Because the equipment offers reduced vibration, it reduces electrical, computer, and mechanical failure, and with less stress on the targets, the equipment jams less and breaks fewer targets. It is believed that no other prior art equipment utilizes this action with an all thread or ACME screw;

2) Bringing the target to the motor, instead of the other way around, greatly simplifies the mechanical, electrical and computer related issues of this type of equipment. The singular motion of the arm and the simple timing involved greatly reduce the stresses on the helice target and allow the use of all manufactured targets, this not being the case for any other automated helice equipment;
3) Electrical components may be potted (sealed in plastic), making them watertight, greatly reducing negative environmental impact. Electrical components may be detached except by a wire(s) to reduce vibration;
4) The equipment is built of lightweight aluminum, making for ease of transport and setup, and this is unique to this equipment—one person can easily lift and move it; and
5) Elastomeric material is placed on the stops in contact with the target at the beak (n), anti-kickback ACME nuts are utilized, and low friction material is used at wear points; every component utilized reduces vibration, wear, and friction, allowing for less maintenance, reducing target breakage, and providing longer machine life and ease of maintenance.

Conventional equipment has several shortcomings:

1) Automated machines, due to various design limitations, are restricted in which helice target manufacture can be loaded into the machines, thereby reducing the supply of targets available to the purchaser. These machines, which are designed to bring the launching motor to the target, instead of the other way around, tend to produce vibration due to excessive motion, as well as loading pressure too great for such a fragile target, resulting in the need for the use of either a less fragile target, which is more difficult for the shooter to break, or the acceptance of a higher incidence of target breakage prior to or upon release from the machine. Target breakage causes equipment to become fouled, increasing the frequency of needed maintenance and repair costs, as well as increasing the amount of time needed to participate in the shooting activity and negatively impacting the experience of both the shooter and the shoot organizer. Attempts to solve unwanted target breakage by utilizing more robust targets negatively impacts shooters' performance and drives them from the sport;
2) Manual machines, on the other hand, have less breakage, but they require much more time and labor, increasing the cost of the sport for shooters and shoot organizers, as well as reducing shooters' enjoyment by greatly slowing the pace of the sport. Increased cost and decreased enjoyment are detrimental to the growth of the sport;
3) Due to the integrated electrical design (one central control) of all other helice equipment, both automated and manual, there exists an electrical problem: even when unplugged, control wires required on or in the ground, connecting the throwers with the controls, subject the entire equipment system to damage from lightning; and
4) Both manual and automated equipment are extremely complicated and difficult to repair, with parts being available only from European countries of manufacture.

In some embodiments, the disclosure, due to its design, makes it possible to shoot any manufacturer's helice target, reduces time and labor, makes for a less expensive, quicker-paced sport, and affords a better experience for everyone involved. The equipment is lightweight and, unlike other equipment, can be lifted and placed with little effort; it also requires less maintenance, and repairs and maintenance are simple, with the vast majority of parts being readily available from auto parts supply stores and online mail-order stores. The decentralized design of the invention at hand allows for no connection between throwers nor any physical connections to a central control, thus overcoming problems with lightning strikes. Due to the novel design of the invention, it has little vibration, reducing or eliminating fastener failure, improving electrical and mechanical stability, and resulting in equipment that is extremely reliable.

The embodiments of the present disclosure can be utilized in shotgun shooting sports other than Helice; for example, the equipment can also be set to throw a non-random target for Sporting Clays disciplines, which do not utilize random targets.

DETAILED DESCRIPTION OF THE DISCLOSURE

Figure 1:
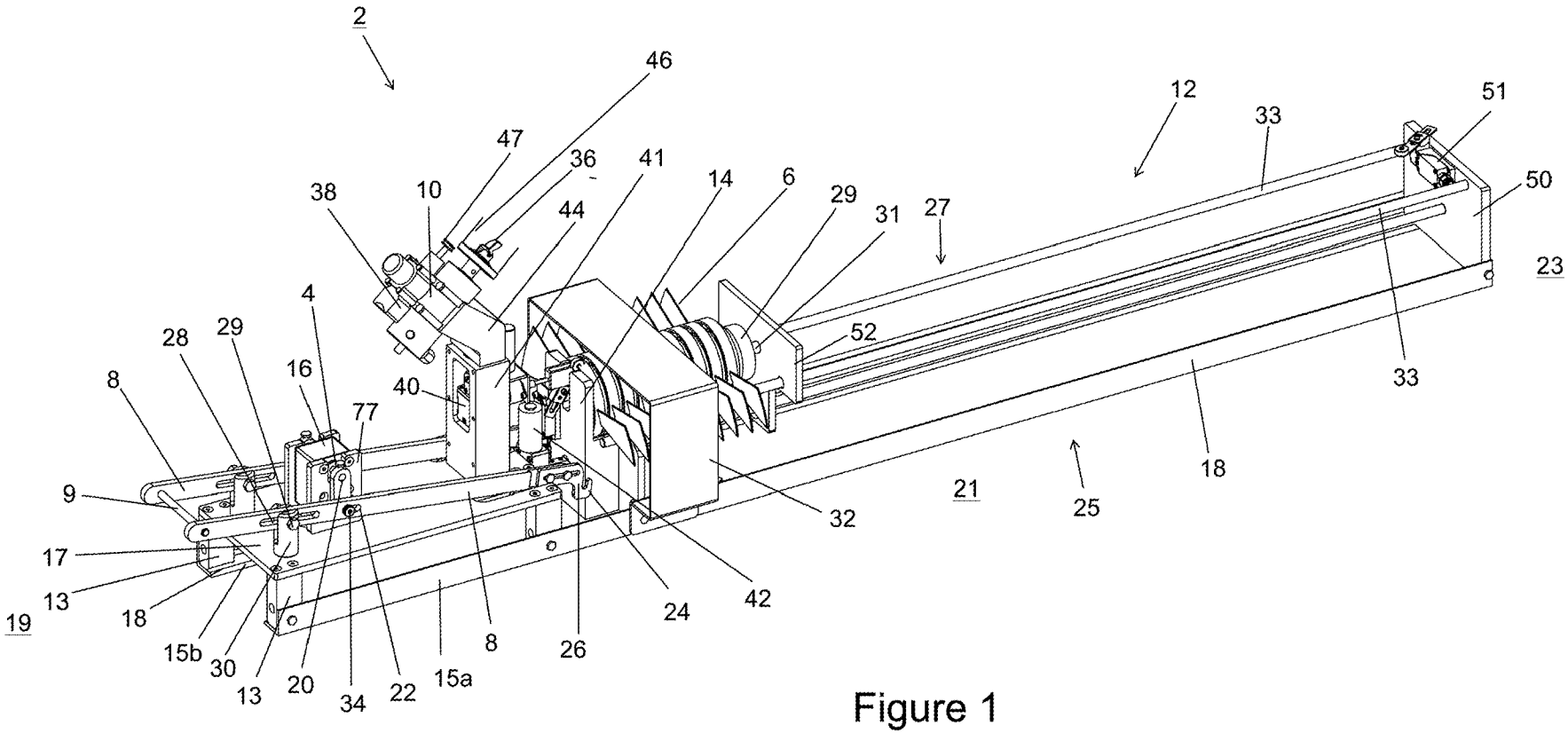
FIG. 1 is a perspective view of an embodiment of the present disclosure in a non-loaded configuration.

This present disclosure describes embodiments of a flying target (helice targets, clay targets, plastic targets, skeet, and the like) launching machine that permits users to shoot targets without having to frequently reload the equipment. The disclosed embodiments make it possible for entities (e.g., shooting clubs) to reduce labor and allow users (e.g., shooters) to shoot more practice.

As shown in FIGS. 1-7, the device 2 for launching a target 6 may include an elongated base 18, an arm motor 16, right and left target loading arms 8, a horizontal linear loader 12, an oscillation motor 40, and a throwing motor 10. The base 18 may include a front section 19, a mid-section 21, and a rear section 23, a left side 25, and a right side 27. The base 18 may have a rectangular shape. The base 18 may include one or more beams that run along the length of the base.

Figure 2:
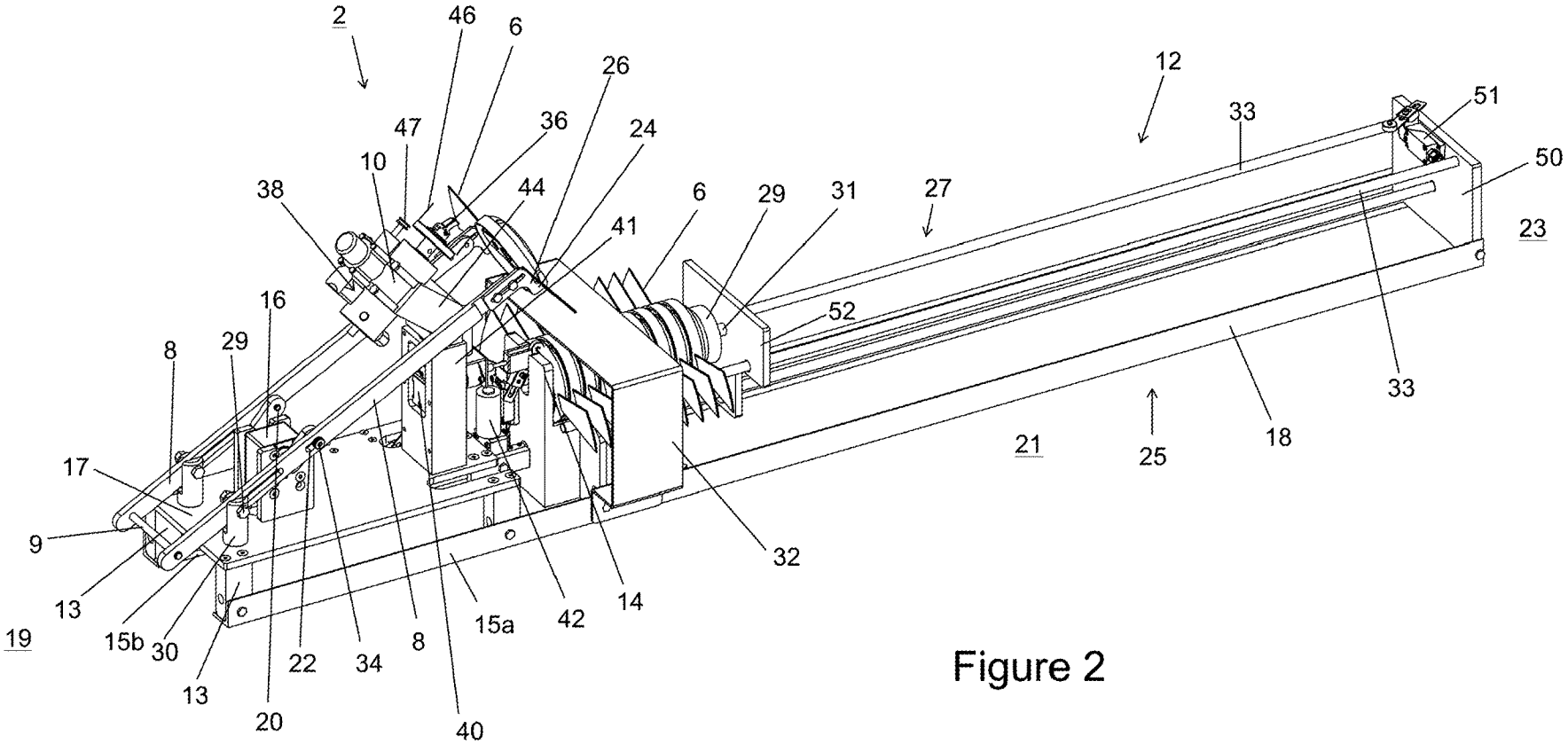
FIG. 2 is a perspective view of an embodiment of the present disclosure in a loaded configuration with loading arms lifted.
Figure 3:
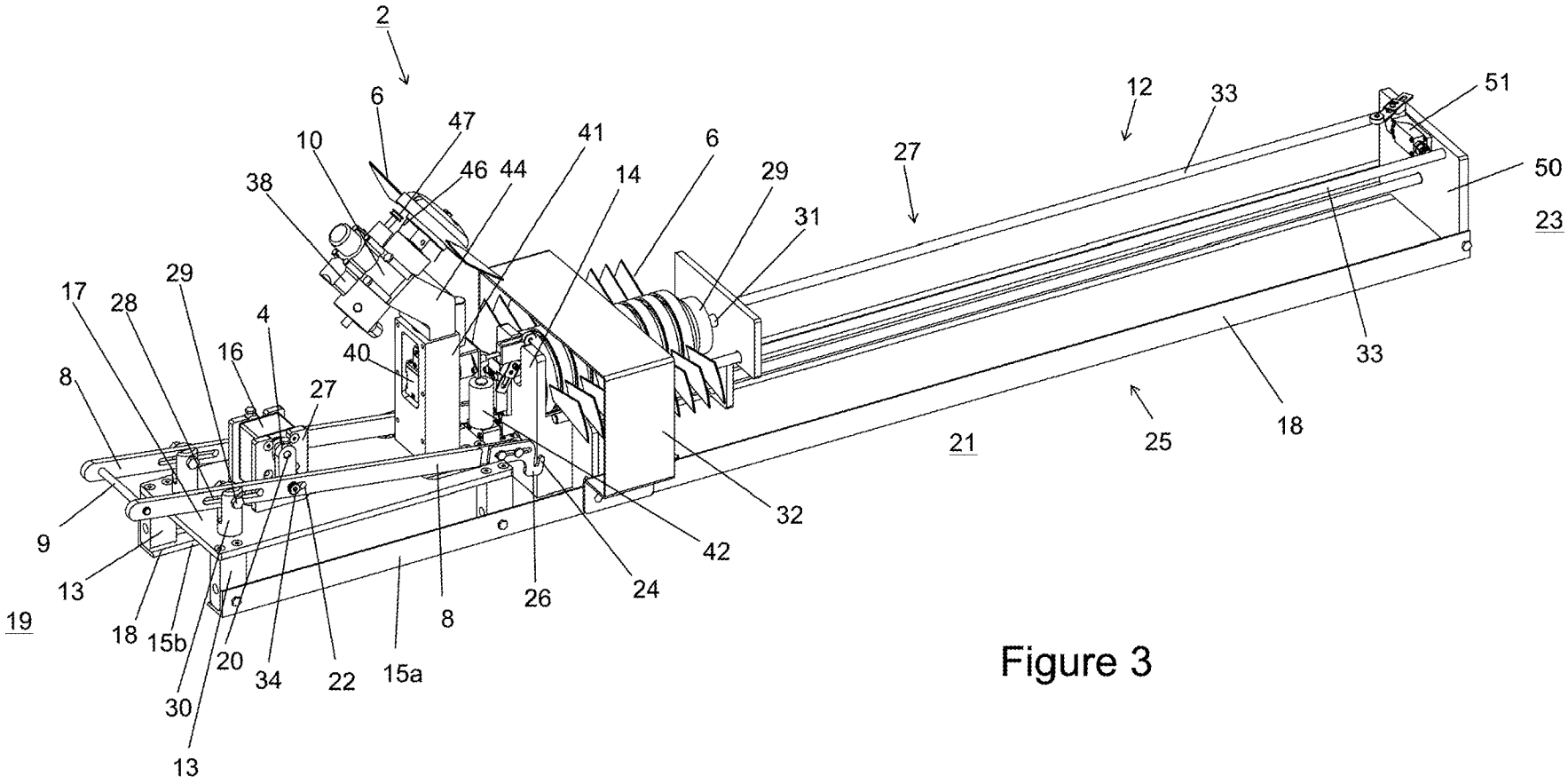
FIG. 3 is a perspective view of an embodiment of the present disclosure in a loaded configuration with loading arms lowered.
Figure 4:
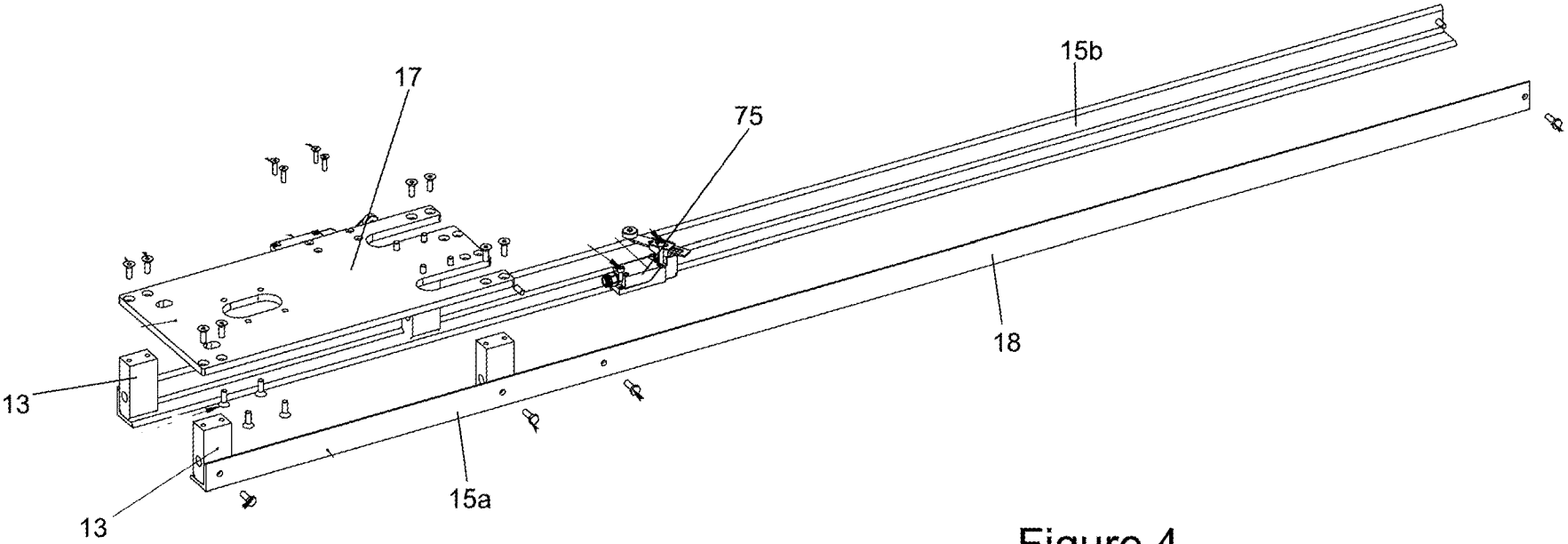
FIG. 4 is an exploded view of an embodiment of the present showing a base assembly and associated components.
Figure 5:
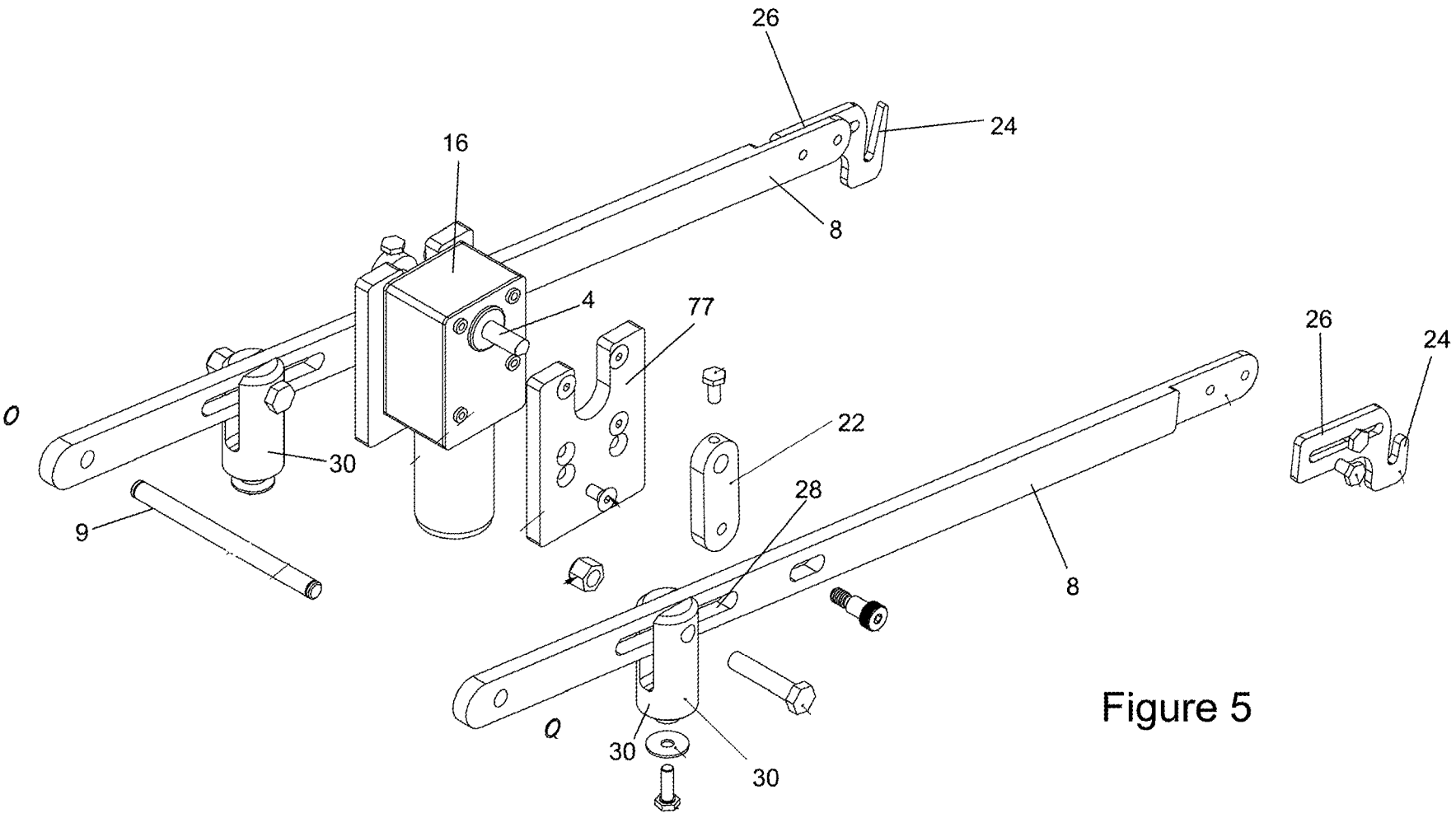
FIG. 5 is an exploded view of an embodiment of the present showing an arm motor, lifting arms, and associated components.
Figure 6:
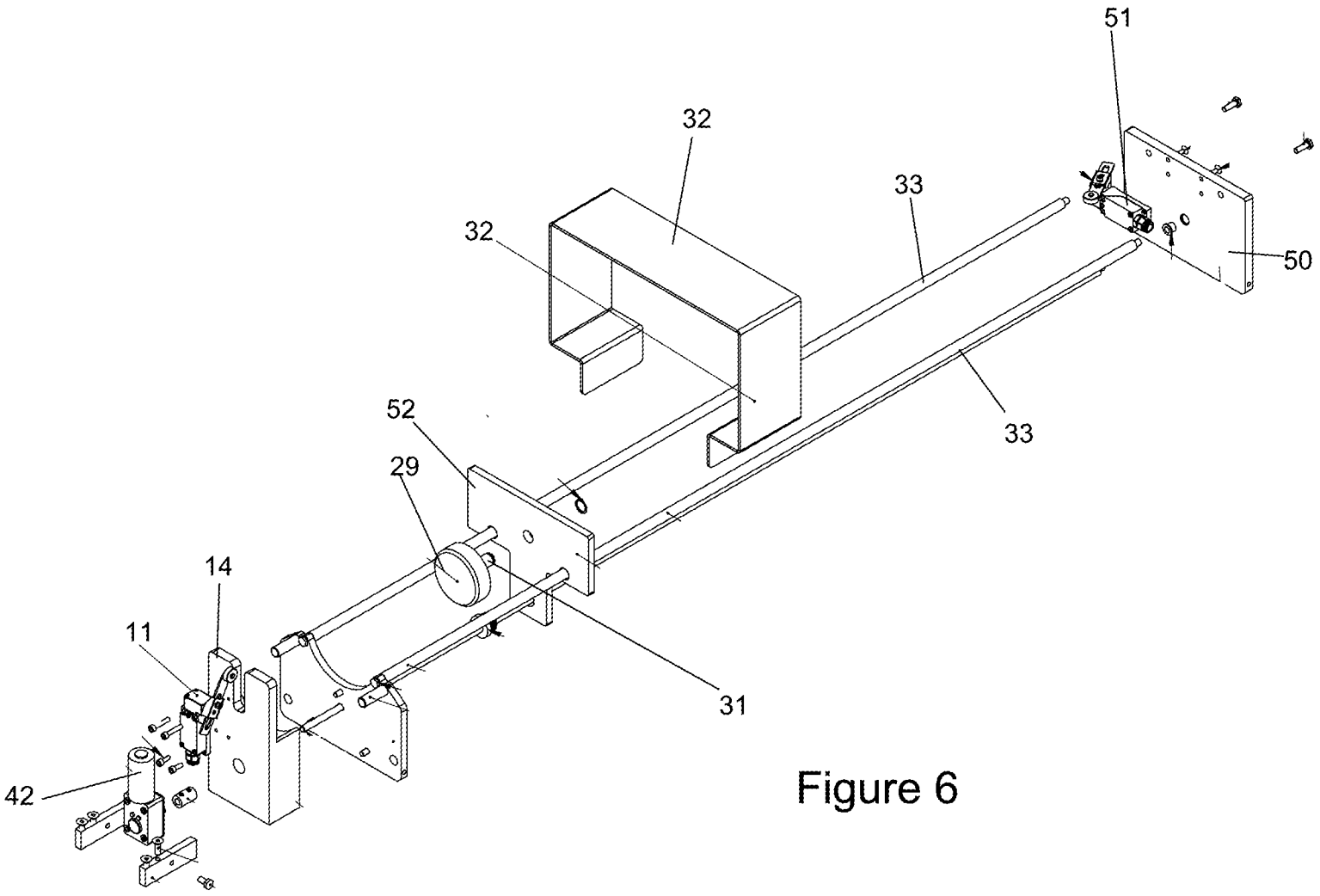
FIG. 6 is an exploded view of an embodiment of the present showing a linear loader and associated components.
Figure 7:
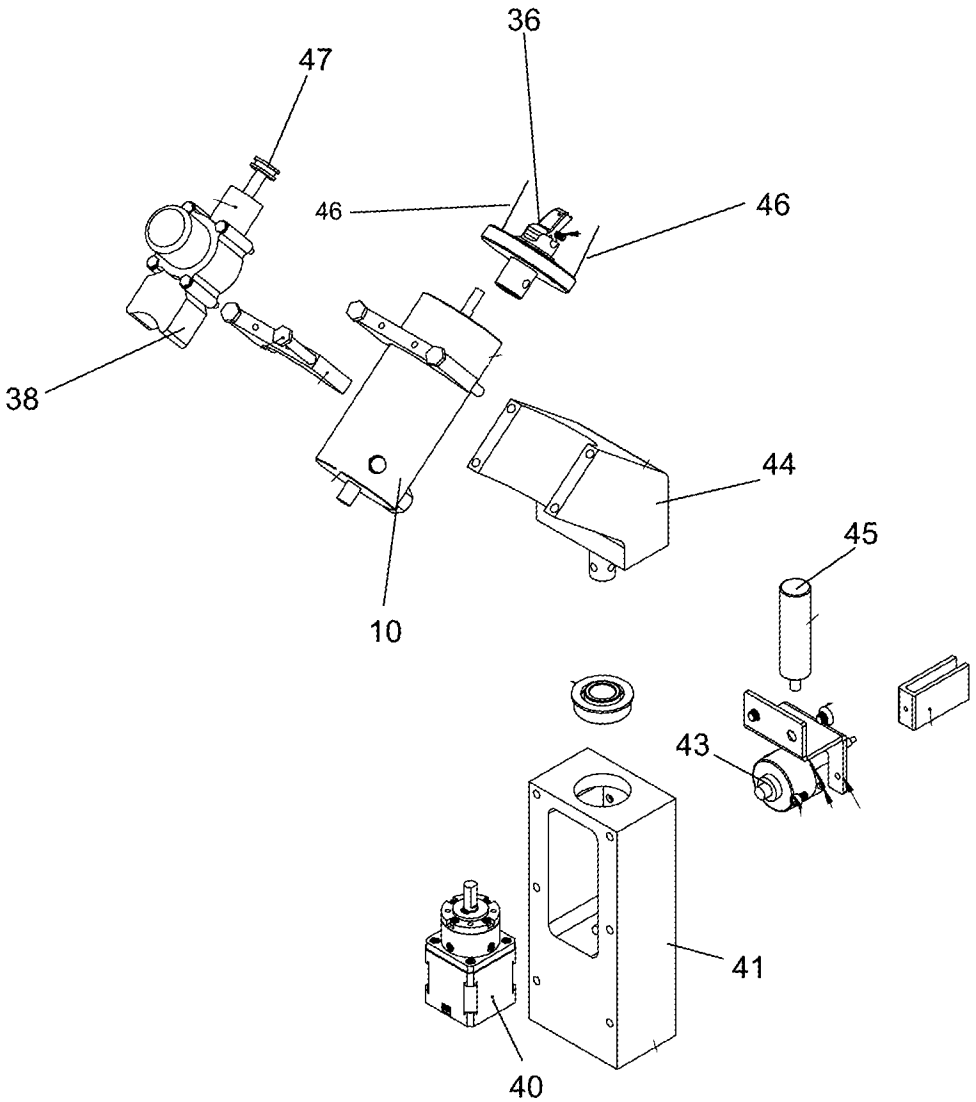
FIG. 7 is an exploded view of an embodiment of the present showing a throwing motor, an oscillation motor, a beak assembly, and associated components.

As shown, FIG. 1 illustrates a perspective view of an embodiment of the present disclosure in a non-loaded configuration, FIG. 2 illustrates a perspective view of an embodiment of the present disclosure in a loaded configuration with loading arms lifted, and FIG. 3 illustrates a perspective view of an embodiment of the present disclosure in a loaded configuration with loading arms lowered. FIG. 4 illustrates an exploded view of an embodiment of the present showing a base assembly and associated components, FIG. 5 illustrates an exploded view of an embodiment of the present showing an arm motor, lifting arms, and associated components, FIG. 6 illustrates an exploded view of an embodiment of the present showing a linear loader and associated components, and FIG. 7 illustrates an exploded view of an embodiment of the present showing a throwing motor, an oscillation motor, a beak assembly, and associated components.

The arm motor 16 may be disposed at the front section 19 of the base 18. For example, the motor 16 may be located between two beams 15*a* and 15*b* of the base 18. In some embodiments, the motor 16 may be supported by a platform 17 that may be supported (e.g., via columns/beams 13) by the base 18. The arm motor 16 may be located in a housing 77, such as a rectangular housing or a mounting housing. A feeder stop 75 may be coupled below the motor 16 (FIG. 4).

A gear motor shaft 4 may be a cylindrical shaft and may be coupled to the arm motor 16 (e.g., a worm gear motor). For example, the shaft 4 may extend horizontally through the housing 77 of the arm motor 16, such that a right side of the gear motor shaft 4 may extend out of the right side of the housing of the motor 16 and the left side of the gear motor shaft 4 may extend out of the left side of the housing of the motor 16. The right side of the shaft 4 may be connected to a right rotating arm 20 extending vertically down from the gear motor shaft 4. A left side of the gear motor shaft 4 may be connected to a left rotating arm 20 extending vertically down from the gear motor shaft 4. The gear motor 16 may rotate the gear motor shaft 4, and the gear motor shaft 4 may rotate the right and left rotating arms 20.

Right and left target loading arms 8 may extend on the right and left sides of the arm motor 16. Each loading arm 8 may extend above the front section 19 of the base 18 to above the mid-section 21 of the base 18. Each loading aim 8 may include a cam assembly 22, which may couple (e.g., via a pin 34) to a corresponding right or left rotating arm 20. The end of each loading arm 8 closer to the mid-section 21 of the base 18 may include a corresponding arm extension 26, which may include a hook 24 disposed near backstop 14. The front ends of the loading arms 8 may be connected by a horizontally-positioned spring rod 9. According to some aspects, the loading arms 8 may each include a slot 28 disclosed in the front portion of the loading arm 8. The loading arms 8 may act to pivot about a pivot point at the slot 28 via a corresponding pivot extension 30 extending up from platform 17, such as when the loading arms 8 are lifting targets 6 and then lowering back down to a lower starting position. The pivot extension 30 may be tubular or any other shape. In some cases, the pivot extension 30 may include a horizontal shaft 29 that may interact and/or lock the arm 8 via the slot 28 with the pivot extension 30, and the arm 8 may pivot about the shaft 29.

The horizontal linear loader 12 may extend above the mid-section 21 of the base 18 to the rear section 23 of the base 18. The linear loader 12 may hold one or a plurality of targets 6. The linear loader may include one or more guiding poles 33 that may guide the targets 6 along the length of the loader 12. The rear of the linear loader 12 may include an end plate 50, which may be connected to the poles 33. Attached to an inner side of the end plate 50 may be a feeder stop 51. The linear loader 12 may include a round spring plunger 29 that may be coupled to a spring 31, where the plunger 29 and spring 31 may act to push or force the targets 6 loaded in the linear loader 12 toward the backstop 14 near the mid-section 21. For example, the linear loader 12 may include a pushing plate (plunger 29) and a spring mechanism (spring 31) that act to push the targets 6 against the backstop 14 via a drive plate 52. In some cases, the linear loader 12 may use an all thread to move targets 6 to set targets 6 against the backstop 14. A cover 32 may extend over the backstop 14 and/or a portion of the plurality of targets. The ends of the cover 32 may be connected to the base 18 (e.g., to beams 15*a* and 15*b*) at the mid-section 21.

The backstop 14 may be disposed near a first end of the linear loader near the mid-section 21 of the base 18. A first target 6 of a plurality of targets 6 may sit against the backstop 14, such that the right and left loading arms 8 via the corresponding arm extensions 26 and/or hooks 24 may lift the first target 6 up from the backstop 14. In some embodiments, the hooks 24 may lift a target 6 by hooking blades or extensions extending out from a central cap of the target 6. According to some aspects, responsive to or after a target 6 is lifted from the backstop 14, the pushing plate (plunger 29) and spring mechanism (spring 31) may push the next target against the backstop 14.

The oscillation motor 40 may be vertically positioned in front of the backstop 14 and may be coupled to a bracket 44 extending above the oscillation motor 40. The oscillation motor 40 may be partially or fully enclosed in a housing 41. The oscillation motor 40 may include or be coupled to a solenoid 43 and a stop 45 (FIG. 7). In some embodiments, a worm motor 42 may be disposed behind the oscillation motor 40. Worm gear motor 42 may be used to turn an ACME rod on linear loader 12. Solenoid 43 may act as a linear driver used to back targets 6 away from backstop 14 and switch 11. This switch 11 may function to stop motor 42 when a target 6 is at backstop 14. The throwing motor 10 may be set at an angle relative to the ground and may be coupled to the top of the bracket 44. A beak assembly 36 may be connected to the throwing motor 10, where the beak assembly 36 may be used to hold a lifted target 6.

The oscillation motor 40 may operate to turn the throwing motor 10, where the turning of the throwing motor 10 spins the lifted target 6 held by the beak assembly 36. For example, the throwing motor 10 may spin the lifted target 6 on the beak assembly 36 via a linear actuator 38, and the linear actuator 38 may release the spinning target 6 from the beak assembly 36 (e.g., responsive to a voice activation or responsive to a manual switch by a user). In some embodiments, the linear actuator 38 may release the lifted target 6 by using plunger 47. In some embodiments, a Bluetooth device may be utilized to program and/or act as a control for the device 2 or for any part of device 2. In some embodiments, the throwing motor 10 may spin the lifted target 6 up to about 10,000 rotations per minute (e.g., before releasing the spinning target 6). In some embodiments, the throwing motor 10 may spin the lifted target 6 on the beak assembly 36 after the loading arms 8 are lowered from the lifted position. In some embodiments, the loading arms 8 lower back to a lower starting point after the lifted target 6 is disposed on the beak assembly 36.

In some cases, the beak assembly 36 may include one or more stops 46 that may contact the lifted target 6, and these stops 46 may include elastomeric material. For example, gravity may pull a metal male stop down into a notch and stops a carrier head in the same position on the notch. When carrier head is reversed, the male stop might have no effect and may allow the carrier head to spin freely. The stop action may orient the carrier head to allow for target insertion.

According to some aspects, any and/or all components described herein may be coupled and/or connected by any coupling means, including (but not limited to), screws, bolts, ties, welding, epoxy, and the like.

The term "about" as used herein will typically mean a numerical value which is approximate and whose small variation would not significantly affect the practice of the disclosed embodiments. Where a numerical limitation is used, unless indicated otherwise by the context, "about" means the numerical value can vary by +/−5%, +/−10%, or in certain embodiments +/−15%, or possibly as much as +/−20%. Similarly, the term "substantially" will typically mean at least 85% to 99% of the characteristic modified by the term. For example, "substantially all" will mean at least 85%, at least 90%, or at least 95%, etc.

While preferred embodiments of the disclosure have been described, it is to be understood that the embodiments described are illustrative only and that the scope of the disclosure is to be defined solely by the appended claims when accorded a full range of equivalence, many variations and modifications naturally occurring to those skilled in the art from a perusal hereof.

What is claimed is:

1. A device for launching a target, comprising:

an elongated base having a front section, a mid-section, and a rear section and a left side and a right side;

an arm motor disposed at the front section of the base;

a gear motor shaft extending horizontally and being coupled to the arm motor, a right side of the gear motor shaft being connected to a right rotating arm extending vertically down from the gear motor shaft, and a left side of the gear motor shaft being connected to a left rotating arm extending vertically down from the gear motor shaft, wherein the arm motor is configured to rotate the gear motor shaft, and the gear motor shaft is configured to rotate the right and left rotating arms;

a right target loading aim and a left target loading arm, each loading arm extending above the front section of the base to above the mid-section of the base, each loading arm having a cam assembly coupled to a corresponding rotating arm, wherein an end of each loading aim closer to the mid-section of the base includes a corresponding arm extension;

a horizontal linear loader extending above the mid-section of the base to the rear section of the base, wherein the horizontal linear load is configured to hold a plurality of targets;

a backstop disposed near a first end of the linear loader near the mid-section of the base, wherein one of the plurality of targets is configured to sit against the backstop, wherein the right and left loading arms via the corresponding arm extensions are configured to lift a target up from the backstop;

an oscillation motor coupled to a bracket extending above the oscillation motor; and a throwing motor coupled to the bracket and extending above the bracket, the throwing motor being connected to a beak assembly configured to hold the lifted target, wherein the oscillation motor is configured to turn the throwing motor, wherein the turning of the throwing motor is configured to spin the lifted target held on the beak assembly.

2. The device of claim 1, wherein the linear loader comprises a pushing plate and a spring mechanism configured to push the plurality of targets up against the backstop, wherein responsive to the lifting of a target up from the backstop, the pushing plate and the spring mechanism pushes a next target in the plurality of targets against the backstop.

3. The device of claim 1, wherein the loading arms each include corresponding slots, each of the loading arms is coupled to the base via the corresponding slot; wherein each of the slots includes a pivot point from which the corresponding loading arms pivots when raised and lowered.

4. The device of claim 1, wherein each arm extension comprises a hook configured to lift a target.

5. The device of claim 4, wherein each hook is configured to lift the target by hooking blades on the target.

6. The device of claim 1, wherein the throwing motor is configured to spin the lifted target on the beak assembly via a linear actuator.

7. The device of claim 6, wherein the throwing motor is configured to spin the target up to about 10,000 rotations per minute.

8. The device of claim 6, wherein the linear actuator is configured to release the spinning target from the beak assembly.

9. The device of claim 8, wherein the linear actuator is configured to release the spinning target responsive to a voice activation.

10. The device of claim 8, wherein the linear actuator is configured to release the spinning target responsive to a manual switch.

11. The device of claim 6, wherein the throwing motor spins the lifted target on the beak assembly after the loading arms are lowered from a lifted position.

12. The device of claim 6, wherein the loading arms lower to a starting point after the lifted target is disposed on the beak assembly.

13. The device of claim 1, wherein the targets are helice targets.

14. The device of claim 1, wherein the targets are clay targets.

15. The device of claim 1, wherein the targets are plastic targets.

16. The device of claim 1, wherein the linear loader uses an all thread to move targets to set against the backstop.

17. The device of claim 1, wherein the beak assembly includes at least one stop configured to contact the lifted target.

18. The device of claim 17, wherein the stop includes elastomeric material.

19. The device of claim 1, wherein a cover extends from and over the midsection of the base.

20. A method of operating a device for launching a target, comprising the steps of:

(a) providing an elongated base having a front section, a mid-section, and a rear section and a left side and a right side; an arm motor disposed at the front section of the base; a gear motor shaft extending horizontally and being coupled to the arm motor, a right side of the gear motor shaft being connected to a right rotating arm extending vertically down from the gear motor shaft, and a left side of the gear motor shaft being connected to a left rotating arm extending vertically down from the gear motor shaft, wherein the aim motor is configured to rotate the gear motor shaft, and the gear motor shaft is configured to rotate the right and left rotating arms; a right target loading arm and a left target loading arm, each loading arm extending above the front section of the base to above the mid-section of the base, each loading arm having a cam assembly coupled to a corresponding rotating arm, wherein an end of each loading arm closer to the mid-section of the base includes a corresponding arm extension; a horizontal linear loader extending above the mid-section of the base to the rear section of the base, wherein the horizontal linear load is configured to hold a plurality of targets; a backstop disposed near a first end of the linear loader near the mid-section of the base, wherein one of the plurality of targets is configured to sit against the backstop, wherein the right and left loading arms via the corresponding arm extensions are configured to lift a target up from the backstop; an oscillation motor coupled to a bracket extending above the oscillation motor; and a throwing motor coupled to the bracket and extending above the bracket, the throwing motor being connected to a beak assembly configured to hold the lifted target, wherein the oscillation motor is configured to turn the throwing motor, wherein the turning of the throwing motor is configured to spin the lifted target held on the beak assembly;

(b) lifting the one of the plurality of targets with the left and right lifting arms;

(c) disposing the lifted target on the beak assembly; and (d) spinning the lifted target via the throwing motor.

21. The method of claim 20, further comprising:

(e) operating the linear actuator to release the spinning target from the beak assembly.

22. The method of claim 21, further comprising:

(f) lifting a second of the plurality of targets with the left and right lifting arms;

(g) disposing the lifted second target on the beak assembly; and (h) spinning the lifted second target via the throwing motor.

23. The method of claim 20, wherein the throwing motor spins the lifted target on the beak assembly after lowering the loading arms from a lifted position.

* * * * *